United States Patent [19]

Choy et al.

[11] Patent Number: 4,548,649

[45] Date of Patent: Oct. 22, 1985

[54] FOAMING AGENT

[75] Inventors: Edmund M. Choy, Columbia, Md.; Mark E. Baran, Blooming Grove, N.Y.

[73] Assignee: Westvaco Corporation, New York, N.Y.

[21] Appl. No.: 554,675

[22] Filed: Nov. 23, 1983

[51] Int. Cl.[4] ..... C08L 3/00

[52] U.S. Cl. ..... 106/213; 106/210; 252/3; 252/307; 252/354; 252/558

[58] Field of Search ..... 252/307, 354, 3, 8.05; 106/213; 521/65

[56] References Cited

U.S. PATENT DOCUMENTS

| | | | |
|---|---|---|---|
| 3,210,240 | 10/1965 | Read et al. | 162/175 |
| 4,208,485 | 6/1980 | Nahta | 521/65 |
| 4,266,976 | 5/1981 | Gregorian et al. | 106/2 |
| 4,353,993 | 10/1982 | McCrossin | 521/65 |

OTHER PUBLICATIONS

Journal of the American Oil Chemists' Soc., vol. 52, No. 7, pp. 219–224 (1975).

*Primary Examiner*—Prince E. Willis
*Assistant Examiner*—Amelia B. Yarbrough

[57] ABSTRACT

A foaming agent for use in the preparation of foam compositions for surface sizing paper or the like comprises the synergistic combination of a $C_{21}$ dicarboxylic acid (DIACID 1550) and an alkylarylsulfonate soap (Na-DDBS).

6 Claims, No Drawings

FOAMING AGENT

BACKGROUND OF THE INVENTION

The use of sizepress solutions for finishing paper and textiles is well known. For instance, it is known to apply pigmented sizepress solutions to paper in the 10% solids range. However, with the use of foam, it is possible to apply the same solution at higher solids (ca. 20%). By applying a higher solids solution, less energy is required to dry the web resulting in reduced energy costs and increased machine speed. In addition, decreasing the sizepress density by air entrainment permits greater flexibility in controlling pickup by the paper.

U.S. Pat. No. 3,210,240 teaches the use of a foamed starch material for sizing paper to improve the bonding between the top surface fibers and the bodies of such papers for enhanced strength and water penetration resistance. U.S. Pat. Nos. 4,208,485 and 4,266,976 teach the use of foamed fabric treating compositions for treating the fabrics to increase fiber strength, flame retardance and resistance to abrasion. In each of these cases, the use of foaming agents is desirable because the foamed compositions require less water or solvent than other types of applications.

The key to a good foaming agent, particularly where the foamed composition is applied to paper substrates, depends upon its ability to reduce the density of the foamed composition to the lowest possible value at a given solids and with a minimum concentration of foaming agent. The prior art mentioned hereinbefore suggests several foaming agents, and combination of foaming agents that have been found to be acceptable for making foam compositions. However, none of the prior art foaming agents achieve the same level of effectiveness produced by the combination of ingredients disclosed herein.

SUMMARY OF INVENTION

The present invention is directed to a novel foaming agent and more particularly to a combination of ingredients that produces a more effective foam density than either of the ingredients taken separately. Thus the present invention discloses a synergistic result from the combination of two foam producing ingredients.

The addition of about 3% of a mixture containing 70% DIACID 1550 dicarboxylic acid and 30% Na-DDBS sulfonate soap to a typical pigmented sizepress solution produces a density reduction of from about 1.1 gm/cc to about 0.13 gm/cc using an Oakes foam generator. The same sizepress formulation at the same solids containing either 2% Na-1550 or 1% Na-DDBS alone produces densities of 0.94 gm/cc and 0.34 gm/cc, respectively, when foamed with an Oakes foam generator. Satisfactory results are achieved using up to 5% of the foam producing mixture on starch and it is believed that this concentration could be extended to about 10% with similar results. Sizepress solids also influence the foaming action. As sizepress solids are reduced, air entrainment is enhanced. For instance, using a foamer level of 3% 1550/DDBS (70/30) on starch, the density may be reduced from 0.25 gm/cc at 25% solids to 0.10 gm/cc at 9% solids.

A low density foam must be utilized in a foam coating process to achieve uniformity of application of the foamed coating and low pickup of the liquid component of the coating by the substrate. Low pickup is desirable to keep costs of liquid removal down and to minimize the amount of finishing agent required to achieve the desired improvements in the substrate.

The methods currently being used to obtain low foam densities include increasing the consumption of foaming agent or utilizing a more active foaming agent, both of which tend to increase costs. Generally, a suitable foaming agent for a given need is determined by trial and error. Thus the optimum foaming agent is not always identified with this process. However, in accordance with the present invention, a systematic survey of known foaming agents and combination of such foaming agents produced the novel discovery disclosed herein.

The synergistic interaction of DIACID 1550 dicarboxylic acid, an emulsifying agent, with the sodium salt of an alkyl benzene sulfonate (Na-DDBS-Sodium dodecyl benzene sulfonate) a detergent surfactant, produced a lower density foam than either component used individually. The combination of ingredients was found to be capable of producing this result in both pigmented and unpigmented coating formulations in the presence of a foam stabilizer, namely, starch.

In this environment, the use of DIACID 1550 dicarboxylic acid provides the ability to, (1) reduce the overall consumption and cost of the foaming agent while maintaining an equivalent foam density thus enabling the user to reduce the pickup of liquid and finishing material in the coating formulation provided the desired property improvement is maintained. Accordingly, the present invention is useful in the paper industry as a coating or surface size application, the textile industry in the surface treatment of fabrics, and the plastics and carpeting industries for producing voids in solid materials.

DETAILED DESCRIPTION

According to the present invention, there is provided an improved foaming agent useful for producing foamed coatings and surface sizing formulations which comprises as the foam producing ingredients DIACID 1550, a $C_{21}$ dicarboxylic acid product normally used as an emulsifying agent and Na-DDBS (sodium dodecyl benzene sulfonate) a detergent surfactant. The synergistic combination of these ingredients was discovered during a systematic survey of known foaming agents.

DIACID 1550 dicarboxylic acid is a product of Westvaco Corporation and is more fully described in an article published in the *Journal of the American Chemists' Society,* Vol. 52, No. 7, pages 219–224 (1975), the contents of which are incorporated herein by reference. The preferred DIACID 1550 dicarboxylic acid contains two major isomers shown below

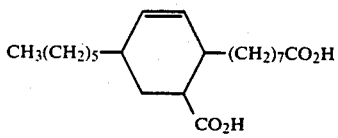

and

-continued

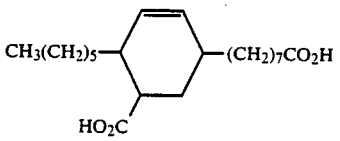

Na-DDBS (sodium alkyl benzene sulfonate) is the most typical and common alkylbenzene sulfonate, a detergent surfactant from the general class of alkylarylsulfonate soaps represented by the formula:

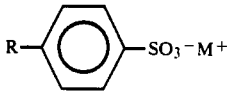

where M is sodium (Na) or potassium (K) and R is dodecyl.

In order to form foam structures, the foaming agent molecules within the bubble walls must orient themselves such that hydrophobic and hydrophilic groups of the foaming agents are aligned properly. The stability of such an orientation requires that the disjoining forces (electrostatic and hydration repulsion) are small compared to the joining forces (hydrophobic free energy and ionic bonds). The structure of the foaming agent achieved influences the disjoining forces. Thus, the synergistic reaction produced by these ingredients is believed to occur because the linear alkylarylsulfonate structure of DDBS is able to form a more stable structure with DIACID 1550 than either of the foaming agents can achieve by themselves.

EXAMPLE I

The foam compositions shown in Table I were prepared using a formulation comprising 1000 parts starch and 600 parts clay. The amount of foaming agent added to each composition was based on the amount of starch in solution. An Oakes foam generator or equivalent apparatus was used to generate foam at 16–21% solids and the densities of the foamed compositions were measured using a standard technique adopted by the textile industry (Ross-Miles Test, described in the text *Surfactants and Interfacial Phenomena*—Rosen, page 209).

TABLE I

| 1550/Na—DDBS Ratio (pts.) | Foam on Starch % | Solids % | Density gm/cc |
|---|---|---|---|
| 100/0 | 1 | 19 | 0.80 |
| 100/0 | 2 | 20 | 0.80 |
| 100/0 | 3 | 20 | 0.81 |
| 90/10 | 3 | 18 | 0.30 |
| 70/30 | 3 | 20 | 0.23 |
| 70/30 | 3 | 18 | 0.13 |
| 50/50 | 3 | 20 | 0.23 |
| 80/20 | 3 | 18 | 0.17 |
| 0/100 | 3 | 21 | 0.15 |
| 0/100 | 1 | 21 | 0.34 |

The data shows that DIACID 1550 alone is not a very good foaming agent notwithstanding the concentration used yielding a foam density of about 0.80 gm/cc. Meanwhile Na-DDBS alone is an effective foaming agent depending upon the concentration added. For instance, the foam densities achieved with 1% Na-DDBS and 2% DIACID 1550 were 0.34 and 0.80 gm/cc respectively. However, the 70/30 ratio (2% DIACID 1550 and 1% Na-DDBS) yielded foam densities of 0.23 and 0.13 gm/cc at solids of 20 and 18%. Thus by combining the foaming agents together, a lower foam density was achieved than would be expected from their individual performances.

No synergism was found using DIACID 1550 dicarboxylic acid in combination with other commercially available foaming agents including Scripset 700 (sodium styrene maleic anhydride) a sizing agent supplied by Monsanto; Rosin soap ($C_{20}$ fatty acid) a sizing agent supplied by Westvaco Corporation; and MONSIZE (Dispersed rosin) a sizing agent supplied by Monsanto. In addition, no synergism was found with DIACID 1550 in combination with alkylsulfates (sodium lauryl sulfate); alkylsulfosuccinates (Aerosol OT-75); branched alkylsulfonates (LAS-97, LAS-95); or linear alkylsulfonates (OS-50S). Accordingly, the present invention is believed to be limited to the use of alkylarylsulfonates with DIACID 1550 dicarboxylic acid.

It is to be understood that the novel foaming agents of the present invention may be used in both pigmented and unpigmented compositions with additives which impart increased strength, good hand, uniform dyeing and finishing, fire resistance and other desired beneficial properties for the substrate being treated. In particular, for application to paper substrates, foam compositions prepared with the foaming agents of the present invention may be successfully used at the wet end of a paper machine as a surface sizing application.

What is claimed is:

1. In a composition suitable for surface application to a fibrous substrate, said composition being a foam produced by the aeration of an aqueous solution containing starch dispersed in water and about 3% by weight of a foaming agent based on the amount of starch in solution comprising the mixture of:

(a) from about 50–90% of a $C_{21}$ dicarboxylic acid having the two major isomers

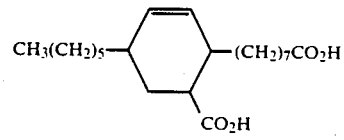

and

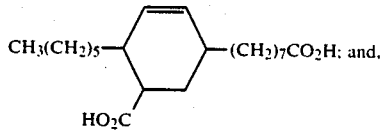

(b) from about 10–50% of an alkylarylsulfonate compound having the formula:

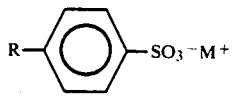

wherein M is selected from the group consisting of Na or K and R is dodecyl, said mixture reacting synergistically to produce a lower foam density than would be expected from the combination of ingredients.

2. The composition of claim 1 wherein the foaming agent mixture comprises about 70% of compound (a) and 30% of compound (b).

3. The composition of claim 2 wherein M is Na.

4. The composition of claim 3 wherein the solids content is from about 16–21% solids.

5. the composition of claim 4 containing a pigment.

6. A foamed composition comprising an aqueous solution of starch, pigment and at least 3% by weight of a foaming agent based on the amount of starch in solution, said foaming agent comprising the mixture of:

(a) 70% of a $C_{21}$ dicarboxylic acid having the two major isomers

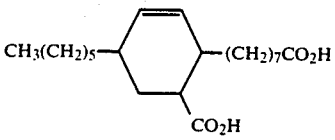

and

-continued

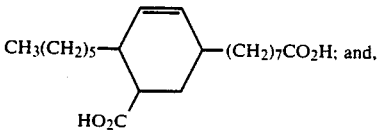

(b) 30% of an alkylarylsulfonate compound having the formula:

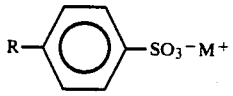

wherein M is selected from the group consisting of Na or K and R is dodecyl, said mixture reacting synergistically to produce a lower foam density than would be expected from the combination of ingredients.

* * * * *